United States Patent [19]

Winston et al.

[11] Patent Number: 4,845,911

[45] Date of Patent: Jul. 11, 1989

[54] MUNTIN FRAMING SYSTEM

[75] Inventors: Felix J. Winston, St. Genevieve; David L. Steinhart, Festus, both of Mo.

[73] Assignee: Di Giorgio Corporation, San Francisco, Calif.

[21] Appl. No.: 108,108

[22] Filed: Oct. 13, 1987

[51] Int. Cl.[4] ..... E06B 1/08; E06B 1/18

[52] U.S. Cl. ..... 52/456

[58] Field of Search ..... 52/456, 235, 455, 314

[56] References Cited

U.S. PATENT DOCUMENTS

| | | | |
|---|---|---|---|
| 1,259,778 | 3/1918 | Roper | 52/456 X |
| 2,655,881 | 10/1953 | Lenke | 108/16 |
| 3,082,848 | 3/1963 | Keller | 52/456 |
| 3,678,651 | 7/1972 | Hicks | 52/311 |
| 4,437,284 | 3/1984 | Cribben et al. | 52/456 |
| 4,439,969 | 4/1984 | Bartlett | 52/461 |
| 4,567,710 | 2/1986 | Reed | 52/790 |
| 4,610,901 | 9/1986 | Linscott | 428/38 |
| 4,672,784 | 6/1987 | Pohlar | 52/235 |

*Primary Examiner*—David A. Scherbel
*Assistant Examiner*—Anthony W. Williams
*Attorney, Agent, or Firm*—Senninger, Powers, Leavitt and Roedel

[57] ABSTRACT

A framing system comprising a sash having a top rail member, a bottom rail member, and a pair of stiles interconnecting the rail members at opposite sides of the sash, and a muntin framework inside the sash for supporting and separating a plurality of individual lights, such as windowpanes. The muntin framework comprises at least one exterior muntin bar extending generally vertically between the top and bottom rail members, at least one exterior muntin bar extending generally horizontally between the stiles, a plurality of interior muntin caps, at least one generally vertical connecting bar connecting said vertical muntin bar and a respective muntin cap, and at least one generally horizontal connecting bar connecting said horizontal muntin bar and a respective muntin cap. The connecting bars are initially separate from the muntin bars and muntin caps and are adapted for assembly with the muntin bars and muntin caps thereby to hold the muntin bars and muntin caps in assembly to form a muntin framework wherein peripheral edge margins of respective lights are disposed between respective muntin bars and muntin caps and wherein the lights are supported and separated from one another by the connecting bars.

26 Claims, 3 Drawing Sheets

MUNTIN FRAMING SYSTEM

BACKGROUND OF THE INVENTION

This invention relates generally to building construction and, more particularly, to a muntin framing system.

True muntin systems, that is, muntin systems which support separate, relatively small individual panes of glass, are expensive to fabricate. As a result, false muntin systems have been developed to achieve the effect of multiple lights without the attendant expense, a false muntin system being one wherein a gridwork of muntins is affixed to one face of a single glazing panel. There has been a recent demand, however, for true or authentic muntin systems, especially in the rehabilitation of older historical homes. Accordingly, there is a need in the industry for a true muntin system which is relatively inexpensive to fabricate and to assemble, and particularly one where the exterior parts of the system are metal clad for protection against the elements.

Reference may be made to U.S. Pat. Nos. 4,610,901, 4,567,710, 4,437,284, 4,439,969, 3,678,651 and 2,665,881 for glazing constructions generally in the field of this invention.

SUMMARY OF THE INVENTION

Among the several objects of this invention may be noted the provision of a true muntin framing system which is relatively inexpensive to fabricate and to assemble; the provision of such a system wherein the exterior components of the system are metal clad better to resist the elements; the provision of such a system which is aesthetically pleasing; the provision of such a system which is readily reglazable in the event a light is damaged; and the provision of such a system which is adapted for tight seals between the muntin components of the system and the lights.

Generally, a framing system of this invention comprises a sash having a top rail member, a bottom rail member, and a pair of stiles interconnecting the rail members at opposite sides of the sash, and a muntin framework inside the sash for supporting and separating a plurality of individual lights, such as windowpanes, each light having an inside face and an outside face and peripheral edge margins. The muntin framework comprises at least one exterior muntin bar extending generally vertically between the top and bottom rail members, at least one exterior muntin bar extending generally horizontally between the stiles, each muntin bar being an extruded member of generally channel shape in cross-section having a web and external flanges at opposite sides of the web, a plurality of interior muntin caps, at least one generally vertical connecting bar connecting said vertical muntin bar and a respective muntin cap, and at least one generally horizontal connecting bar connecting said horizontal muntin bar and a respective muntin cap. The connecting bars are initially separate from said muntin bars and muntin caps and are adapted for assembly with the muntin bars and muntin caps thereby to hold the muntin bars and muntin caps in assembly to form the aforesaid muntin framework wherein peripheral edge margins of respective lights are disposed between respective muntin bars and muntin caps and wherein the lights are supported and separated from one another by said connecting bars.

Other objects and features will be in part apparent and in part pointed out hereinafter.

BRIEF DESCRIPTION OF THE DRAWINGS

Corresponding reference numerals indicate corresponding parts through the several views of the drawings.

DESCRIPTION OF THE PREFERRED EMBODIMENT

Figure 2:
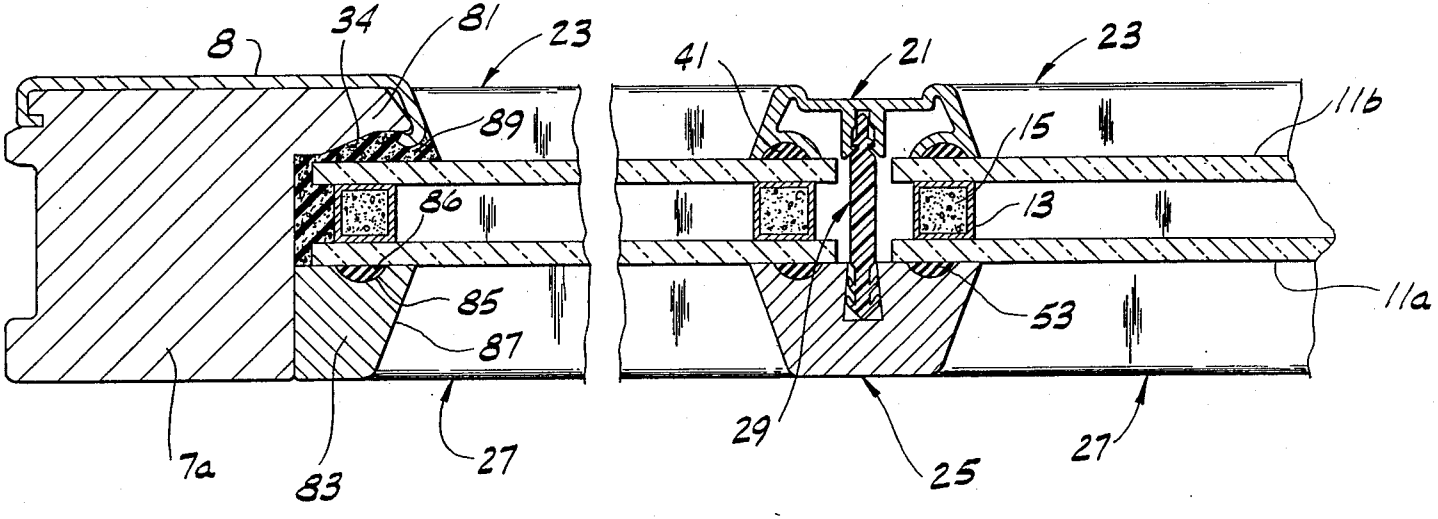
FIG. 2 is a section taken on line 2—2 of FIG. 1.

Referring now to the drawings, a framing system of the present invention is shown as comprising a sash generally designated 1 having a top rail member 3, a bottom rail member 5, and a pair of vertical stiles *7a, 7b* interconnecting the rail members at opposite sides of the sash. The rails and stiles may be of conventional wood construction with aluminum sash cladding 8 being provided on the exterior faces of the members to protect against the elements. The system also includes a muntin framework generally indicated at 9 inside the sash for supporting and separating a plurality of individual lights 11 (e.g., windowpanes). These lights 11 are illustrated in FIG. 2 as being double-paned insulated lights each having an inside pane 11*a* constituting the inside face of the light and an outside pane 11*b* constituting the outside face of the light spaced apart by a rectangular frame of square tubing 13 filled either with moisture absorbent material 15 or with a composite sealant, spacer, and dedicant substrate sold under the trademark "Swiggle Strip". It will be understood, of course, that the muntin framework 9 of this invention will also accommodate single-pane and multiplepane lights of different construction. The framing system of the present invention may be used in widow, door and other configurations.

Figure 3:
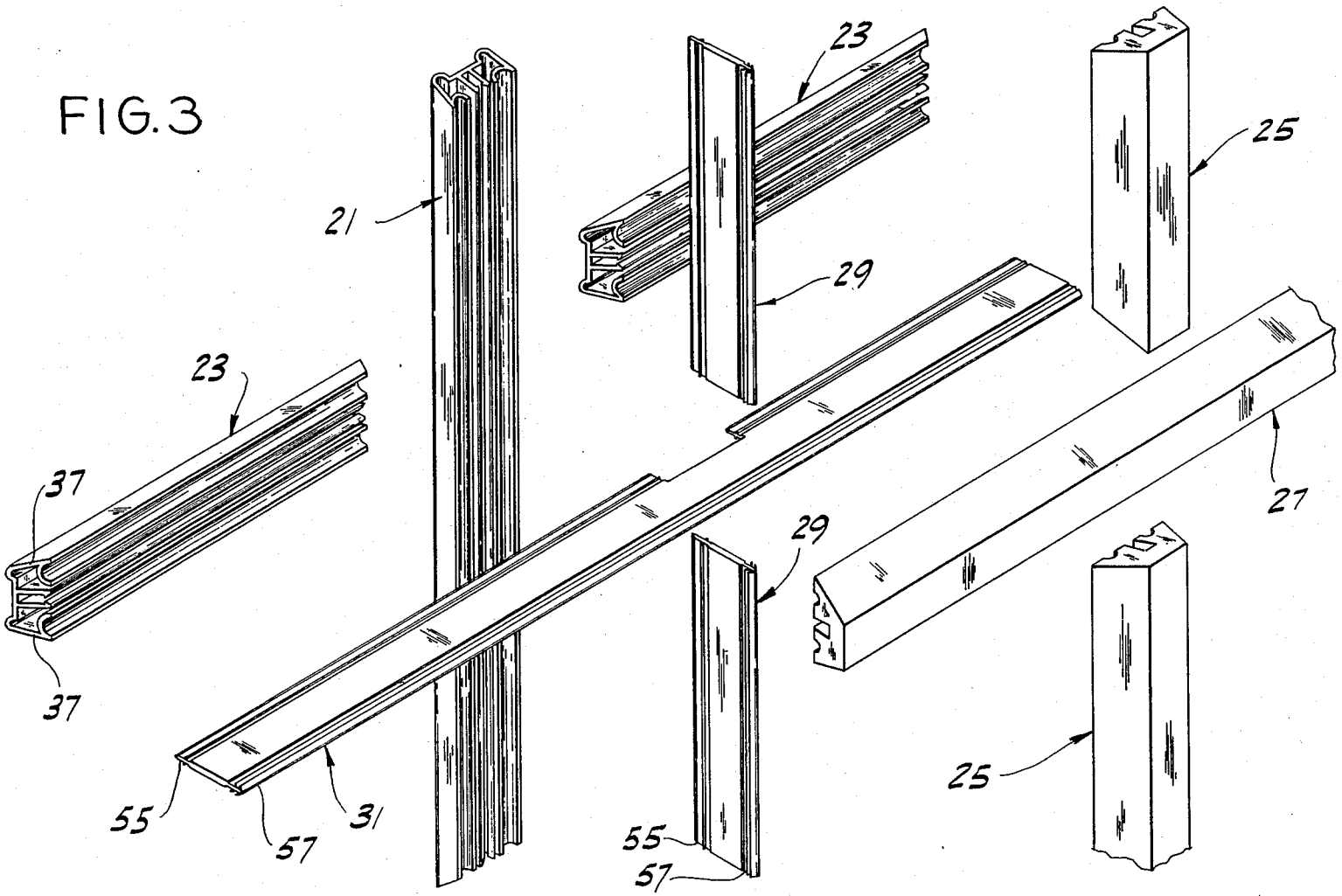
FIG. 3 is an exploded view illustrating the interfit of muntin bars and connecting bars of the system.

As shown best in the partial exploded view of FIG. 3, the muntin framework shown in the drawings comprises a plurality of exterior muntin bars, each generally designated 21, extending generally vertically between the top and bottom rail members 3, 5, a plurality of exterior muntin bars, each generally indicated at 23, extending generally horizontally between the stiles *7a, 7b*, a plurality of interior vertical muntin caps, each generally designated 25, and a plurality of interior horizontal muntin caps, each designated 27. The framework also includes a plurality of generally vertical connecting bars, each generally indicated at 29, connecting the vertical muntin bars 21 and respective vertical muntin caps 25, and a plurality of generally horizontal connecting bars, each designated 31, connecting the horizontal muntin bars 23 and respective horizontal muntin caps 27. The connecting bars 29, 31 are initially separate from the muntin bars 21, 23 and muntin caps 25, 27 and are adapted for assembly with the muntin bars and muntin caps thereby to hold these members in assembly to form the aforesaid muntin framework 9 wherein peripheral edge margins of respective lights 11 are disposed between respective muntin bars and muntin caps and wherein the lights are supported and separated from one another by the connecting bars 29, 31.

Figure 1:
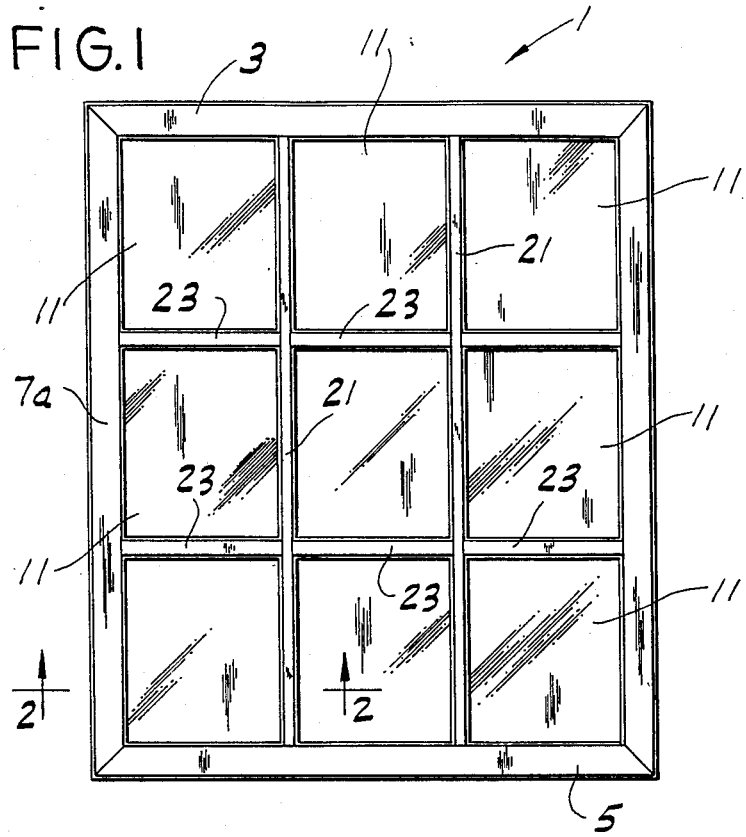
FIG. 1 is an elevation of a muntin framing system of this invention.
Figure 4:
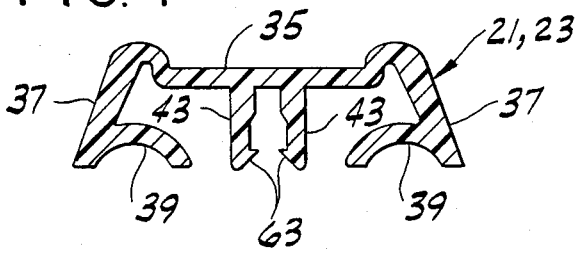
FIG. 4 is a sectional view of a muntin bar of the system.

The exterior muntin bars 21, 23 are extruded members of suitably durable and weather resistant material (e.g., aluminum) and are of generally channel shape in cross section (see FIG. 4). Thus each muntin bar has a web 35 and external flanges 37 at opposite sides of the web which diverge in the direction away from the web. The flanges 37 have inturned lips 39 at their outer edges curved to form channels configured for holding sealing material 41 adapted for sealing engagement with the outside faces or panes 11*b* of respective lights 11, as shown in FIG. 2. The sealing material may be, for example, a foamed hot-melt butyl rubber sealant. Each muntin bar 21, 23 also has means comprising a pair of integral generally parallel internal flanges 43 extending longitudinally of the web 35 forming a channel running lengthwise of the bar. These flanges are sufficiently flexibly resilient (i.e., springy) as to permit them to spread apart to receive a connecting bar 29, 31, as will become apparent.

Figure 5:
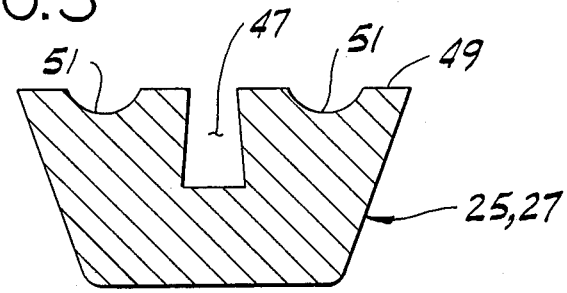
FIG. 5 is a sectional view of a muntin cap of the system.

Referring now to FIG. 5, an interior muntin cap 25, 27 is shown as comprising a member of frustro-conical shape in transverse section. For aesthetic reasons, the cap is preferably of wood. It has a relatively deep central recess or groove 47 in its outer face 49 extending lengthwise of the cap and a pair of parallel relatively shallow concave grooves 51 in its outer face on opposite sides of the central groove 47 extending the length of the cap for holding sealing material 53 (which may be identical to sealant 41) adapted for sealing engagement with the inside faces 11*a* of respective lights 11.

Figure 6:
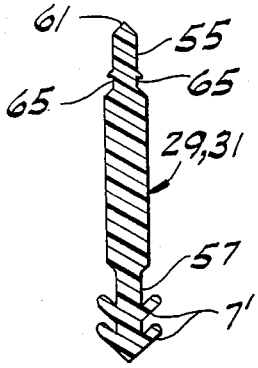
FIG. 6 is a sectional view of a connecting bar of the system.

FIG. 6 illustrates the construction of a connecting bar 29, 31. As shown, the bar is a relatively thin flat rectangular member, preferably of extruded relatively stiff plastic (e.g., vinyl), having generally parallel longitudinal side edge margins indicated at 55 and 57. The first or outer of these edge margins 55 is adapted to be inserted in the channel defined by the internal flanges 43 of a respective muntin bar 21, 23, as shown in FIG. 2. The edge of the connecting bar is tapered at 61 to facilitate this insertion to a point where inwardly projecting detents 63 at the outer edges of the internal flanges 43 snap or spring into grooves 65 running the length of the connecting bar 29, 31 thereby to secure the connecting bar to the external muntin bar in a position wherein the edge or apex of the connecting bar is received snugly between the flanges 43 of the muntin bar to provide lateral stability. It will be noted, that the central portion of the edge margin 55 is dimensioned less than the distance between the internal flanges 43 to minimize friction and thus facilitate assembly. The thickness of the edge margin immediately outward of the grooves 65 is greater than the distance between the detents 63 to ensure proper securement of the connecting bar to the muntin bar.

The second or inner edge margin 57 of the connecting bar 29, 31 has two sets of barbs 71 formed thereon receivable in the central recess or groove 47 in a respective muntin cap 25, 27 thereby releasably to secure the cap to the connecting bar. The barbs or preferably of a relatively soft material (e.g., 64 Shore A durometer plastic) compared to the remainder of the connecting bar to permit flexing of the barbs as the inner edge margin of the bar is inserted into the central groove of the muntin cap. The friction of the barbs 71 (constituting friction fit means) against the side walls of the groove releasably holds the muntin cap and connecting bar in assembly. The barbs are preferably at an angle of about 45° relative to the connecting bar.

The width of the connecting bars 29, 31 will vary depending on the thickness of the light 11 being used. It will be understood in this regard that the width of the connecting bars should be such as to space the muntin bars 21, 23 and muntin caps 25, 27 from one another a distance only slightly greater than the thickness of the lights 11 to provide a snug and sealing fit by using the aforementioned sealing material.

Referring again to FIG. 3, it will be seen that the vertical exterior muntin bars 21 are relatively long bars having lengths sufficient to extend continuously substantially from the top rail member 3 to the bottom rail member 5 of the sash, and that each horizontal muntin bar 23 is a shorter bar having a length generally corresponding to (somewhat less than) the width of a respective light 11. The ends of the horizontal muntin bars 23 are adapted to be cut an angle to interfit flush against the external flanges 37 of the vertical muntin bars 21 and against the sash cladding 8 (see FIG. 2). Each horizontal connecting bar 31 is a relatively long bar having a length sufficient to extend continuously substantially from one stile 7*a* of the sash to the other stile 7*b*, and each such connecting bar 31 has a plurality of notches 77 therein to receive and permit passage of the vertical muntin bars 21. Each vertical connecting bar 29 is a shorter bar having a length substantially corresponding to the height of a respective light 11. The lights 11 are intended for engagement at their upper and lower edges with respective horizontal connecting bars 31, while the side edges of the lights are intended to be slightly spaced from the the vertical connecting bars 29, as shown in FIG. 2.

As further shown in FIG. 3, the horizontal muntin caps 27 have lengths substantially corresponding to the horizontal connecting bars 31, that is, lengths sufficient to extend continuously substantially from adjacent one side of the sash to adjacent the opposite side of the sash. The vertical muntin caps 25 are shorter, having lengths generally corresponding to the lengths of the vertical connecting bars 29. The ends of the muntin caps are cut at angles to fit flush against the angled sides of adjoining muntin caps.

The manner in which the muntin framework 9 and lights 11 are secured in the sash 1 is best illustrated in FIG. 2. It will be observed in this regard that the sash is formed with a lip 81 around its inner periphery adjacent the exterior face of the sash projecting laterally inwardly into the opening defined by the sash. A plurality of glazing bars 83 also extend around the inner perimeter of the sash generally parallel to but spaced from the lip 81 on the interior side of the lip to form a channel which runs around the inside perimeter of the sash and receives peripheral edge margins of perimeter lights 11 thereby to secure the muntin system and lights in fixed position relative to the sash. The glazing bars 83 are suitably fastened to the sash and each has a central groove 85 therein for receiving a suitable sealant 86 (which may be identical to sealant 41) to seal against the inside faces of the perimeter lights. One face 87 of each glazing bar 83 is angled to fit flush with the angled ends of respective mullion caps 25, 27. To ensure a tight sealing fit between the sash (including sash lip 81) and the muntin framework 9 and lights 11, suitable sealant 89 (e.g., a foamed hot-melt butyl rubber sealant) is introduced into the aforementioned channel in the space between the sash and the peripheral edges of the muntin framework 9 and perimeter lights 11.

It will be observed from the foregoing description that the framing system of the present invention is simple to assemble in that it requires no routing or drilling in the perimeter sash parts. The system is also easy to reglaze by removing the appropriate glazing bars 83 and muntin caps 25, 27, replacing the damaged light 11 or lights, and reinstalling the muntin caps and glazing bars with new sealant where needed. Also, because the exterior parts of the muntin framework 9 are of aluminum, they are weather resistant, durable and require a minimum of maintenance. Moreover, because the external muntin bars 21, 23 are of metal (e.g., aluminum), they can be made relatively narrow (e.g., one inch wide) to enhance their attractiveness.

In view of the above, it will be seen that the several objects of the invention are achieved and other advantageous results attained.

As various changes could be made in the above constructions without departing from the scope of the invention, it is intended that all matter contained in the above description or shown in the accompanying drawings shall be interpreted as illustrative and not in a limiting sense.

What is claimed is:

1. A framing system comprising a sash having a top rail member, a bottom rail member, and a pair of stiles interconnecting the rail members at opposite sides of the sash, and a muntin framework inside the sash for supporting and separating a plurality of individual lights, such as windowpanes, each light having an inside face and an outside face and peripheral edge margins, said muntin framework comprising at least one exterior muntin bar extending generally vertically between the top and bottom rail members, at least one exterior muntin bar extending generally horizontally between the stiles, a plurality of interior muntin caps, at least one generally vertical connecting bar connecting said vertical muntin bar and a respective muntin cap, and at least one generally horizontal connecting bar connecting said horizontal muntin bar and a respective muntin cap, each connecting bar comprising a relatively thin elongate member having first and second generally parallel side edge margins extending longitudinally of the member at opposite sides thereof, said first side edge margin being formed for connection to a respective exterior muntin bar substantially continuously along the muntin bar and said second side edge margin being formed for connection to a respective muntin cap substantially continuously along the muntin cap, said connecting bars being initially separate from said muntin bars and muntin caps and being adapted for assembly with said muntin bars and muntin caps thereby to hold the muntin bars and muntin caps in assembly to form a muntin framework wherein peripheral edge margins of respective lights are disposed between respective muntin bars and muntin caps and wherein the lights are separated from one another by said connecting bars with said connecting bars providing support to the muntin framework substantially continuously across substantially the entire width of the framework between the stiles of the sash and substantially continuously along substantially the full height of the framework between the top and bottom rail members of the sash.

2. A framing system as set forth in claim 1 wherein each muntin bar is an extruded member of generally channel shape in cross-section having a web and external flanges at opposite sides of the web.

3. A framing system as set forth in claim 1 wherein each muntin bar has means forming a channel running lengthwise of the bar for receiving said first longitudinal side edge margin of a respective connecting bar.

4. A framing system as set forth in claim 2 wherein each muntin bar has inturned lips at the outer edges of said external flanges, said lips being configured for holding sealing material adapted for sealing engagement with the outside faces of respective lights.

5. A framing system as set forth in claim 3 wherein said channel-forming means comprises a pair of generally parallel internal flanges extending longitudinally of the web.

6. A framing system as set forth in claim 5 wherein each muntin cap has a recess running lengthwise of the cap for receiving said second longitudinal edge margin of a respective connecting bar.

7. A framing system as set forth in claim 6 further comprising detent means for securing the first longitudinal side edge margin of each connecting bar in said channel-forming means of a respective muntin bar.

8. A framing system as set forth in claim 7 wherein said detent means comprises at least one recess extending longitudinally of said connecting bar adjacent said first side edge margin of the bar and a spring detent associated with said channel-forming means receivable in said recess for securing the first side edge margin of the connecting bar in said channel-forming means.

9. A framing system as set forth in claim 6 further comprising means for releasably securing the second longitudinal edge margin of each connecting bar in said recess of a respective muntin cap.

10. A framing system as set forth in claim 1 wherein each muntin cap has a pair of generally parallel grooves therein extending lengthwise of the cap for holding sealing material adapted for sealing engagement with the inside faces of respective lights.

11. A framing system as set forth in claim 1 wherein said muntin bars and connecting bars are of extruded metal and said muntin caps are of wood.

12. A framing system as set forth in claim 11 wherein each muntin cap is of frusto-conical shape in cross section.

13. A framing system as set forth in claim 1 wherein each vertical muntin bar is a relatively long bar having a length sufficient to extend continuously substantially from the top rail member to the bottom rail member of the sash, each horizontal muntin bar being a shorter bar having a length generally corresponding to the width of a light, and wherein each horizontal muntin cap is a relatively long cap having a length sufficient to extend continuously substantially from one stile to the other.

14. A framing system as set forth in claim 13 wherein each horizontal connecting bar is a relatively long bar having a length sufficient to extend continuously substantially from one stile of the sash to the other, each horizontal connecting bar having a notch therein to receive each vertical muntin bar, each vertical connecting bar being a shorter bar having a length substantially corresponding to the height of a light.

15. A framing system as set forth in claim 1 further comprising a lip around the inner perimeter of the sash extending laterally inwardly into the opening defined by the sash and a plurality of glazing bars around the inner perimeter of the sash extending generally parallel to but spaced from the lip to form a channel running around the inner perimeter of the sash for receiving peripheral edge margins of perimeter lights thereby to secure the muntin system and lights in fixed position relative to the sash.

16. A muntin system for supporting and separating a plurality of individual lights, such as windowpanes, each light having an inside face and an outside face and peripheral edge margins, said system comprising at least one exterior muntin bar adapted to extend generally vertically, at least one exterior muntin bar adapted to extend generally horizontally, a plurality of interior muntin caps, at least one generally vertical connecting bar for connecting said vertical muntin bar and a respective muntin cap, and at least one generally horizontal connecting bar for connecting said horizontal muntin bar and a respective muntin cap, each connecting bar comprising a relatively thin elongate member having first and second generally parallel side edge margins extending longitudinally of the member at opposite sides thereof, said first side edge margin being formed for connection to a respective exterior muntin bar substantially continuously along the muntin bar and said second side edge margin being formed for connection to a respective muntin cap substantially continuously along the muntin cap, said connecting bars being initially separate from said muntin bars and muntin caps and being adapted for assembly with said muntin bars and muntin caps thereby to hold the muntin bars and muntin caps in assembly to form a muntin framework wherein peripheral edge margins of respective lights are disposed between respective muntin bars and muntin caps and wherein the lights are separated from one another by said connecting bars with said connecting bars providing support to the muntin framework substantially continuously across substantially the entire width of the framework between the stiles of the sash and substantially continuously along substantially the full height of the framework between the top and bottom rail members of the sash.

17. A muntin system as set forth in claim 16 wherein each muntin bar is an extruded member of generally channel shape in cross-section having a web and external flanges at opposite sides of the web.

18. A muntin system as set forth in claim 17 wherein each muntin bar has inturned lips at the outer edges of said external flanges, said lips being configured for holding sealing material adapted for sealing engagement with the outside faces of respective lights.

19. A muntin system as set forth in claim 17 wherein said muntin bars and connecting bars are of extruded metal and said muntin caps are of wood.

20. A muntin system as set forth in claim 17 wherein each muntin bar has means forming a channel running, lengthwise of the bar for receiving said first longitudinal side edge margin of a respective connecting bar.

21. A muntin system as set forth in claim 20 wherein said channel-forming means comprises a pair of generally parallel internal flanges extending longitudinally of the web.

22. A muntin system as set forth in claim 21 wherein each muntin cap has a recess running lengthwise of the cap for receiving said second longitudinal said edge margin of a respective connecting bar.

23. A muntin system as set forth in claim 22 further comprising means for releasably securing longitudinal edge margin of each connecting bar in said recess of a respective muntin cap.

24. A muntin system as set forth in claim 22 further comprising detent means for releasably securing the first longitudinal side edge margin of each connecting bar in said channel-forming means of a respective muntin bar.

25. A muntin system as set forth in claim 24 wherein said detent means comprises at least one recess extending longitudinally of said connecting bar adjacent said first side edge margin of the bar and a spring detent associated with said channel-forming means receivable in said recess for releasably securing the first side edge margin of the connecting bar in said channel-forming means.

26. A muntin system as set forth in claim 16 wherein each muntin cap has a pair of generally parallel grooves therein extending lengthwise of the cap for holding sealing material adapted for sealing engagement with the inside faces of respective lights.

* * * * *